US006699118B1

(12) United States Patent
Wahner et al.

(10) Patent No.: US 6,699,118 B1
(45) Date of Patent: Mar. 2, 2004

(54) VENT APPARATUS

(75) Inventors: Adam William Wahner, Sullivan, IL (US); Scott W. Keller, Charleston, IL (US); Lonnie E. Holder, Sullivan, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 0 days.

(21) Appl. No.: 10/305,282

(22) Filed: Nov. 26, 2002

(51) Int. Cl.[7] ..... F23L 17/02
(52) U.S. Cl. ..... 454/20; 454/5
(58) Field of Search ..... 454/20, 4, 5, 275, 454/276, 367, 368; 52/198, 199

(56) References Cited

U.S. PATENT DOCUMENTS

| | | | | | |
|---|---|---|---|---|---|
| 71,964 | A | * | 12/1867 | Boyd | 454/20 |
| 530,418 | A | * | 12/1894 | Ingalls | 454/20 |
| 888,728 | A | * | 5/1908 | McLean | 454/20 |
| 891,957 | A | * | 6/1908 | Schubert | 454/20 |
| 1,271,166 | A | * | 7/1918 | Hutton | 454/20 |
| 1,420,141 | A | * | 6/1922 | Pennington | 454/20 |
| 1,496,797 | A | * | 6/1924 | Wasaka | 454/20 |
| 1,505,794 | A | * | 8/1924 | McCarty | 454/20 |
| 3,022,717 | A | * | 2/1962 | Webster | 454/4 |
| 4,144,802 | A | | 3/1979 | Babin | |
| 4,147,096 | A | * | 4/1979 | Caswell | 454/20 |
| 4,320,697 | A | | 3/1982 | Smith | |
| 4,572,059 | A | | 2/1986 | Ramsay | |
| 5,088,947 | A | | 2/1992 | Whitley, II et al. | |
| 5,213,542 | A | | 5/1993 | Kelly | |
| 5,314,387 | A | | 5/1994 | Hauser et al. | |
| 5,749,780 | A | | 5/1998 | Harder et al. | |
| 6,015,444 | A | | 1/2000 | Craft et al. | |
| 6,122,996 | A | | 9/2000 | Hauser et al. | |
| 6,185,936 | B1 | | 2/2001 | Hauser et al. | |
| 6,199,380 | B1 | | 3/2001 | Ishii | |
| 6,216,560 | B1 | | 4/2001 | Takada et al. | |
| 6,233,929 | B1 | | 5/2001 | Okada et al. | |
| 6,364,924 | B1 | | 4/2002 | Mashiko et al. | |
| 6,374,425 | B2 | | 4/2002 | Downey | |
| 6,401,869 | B1 | | 6/2002 | Iida et al. | |
| 6,447,565 | B1 | | 9/2002 | Raszkowski | |

* cited by examiner

*Primary Examiner*—Derek Boles
(74) *Attorney, Agent, or Firm*—Neal, Gerber & Eisenberg, LLP

(57) ABSTRACT

A vent apparatus for an enclosed space such as that within a structure or a vehicle, including a vent tube having a first end that extends outside of the closed space and a second end that is connected to the enclosed space and a vent cap removably coupled to the vent tube and capable of pivoting or swiveling with respect to the vent tube to prevent water from entering the reservoir through the vent tube.

22 Claims, 5 Drawing Sheets

VENT APPARATUS

BACKGROUND OF THE INVENTION

This invention relates generally to a vent apparatus and more particularly, to a vent apparatus having a pivotal vent cap that may be used in a wide variety of applications where it is needed to provide airflow to or from a closed or enclosed space, while also preventing water or other similar elements from entering the closed space.

Vents and vent caps are known in the art. Generally, these devices include a vent cap mounted to a vent, which extends into a opening. The vent cap usually assumes a conical or triangular shape and functions to keep water, ice, snow or other such elements from entering the vent from a position substantially perpendicular to and above the vent cap. While the existing vent caps have been relatively successful at keeping water or other elements from entering the vent from perpendicular positions above the vent cap, such vent caps are susceptible to water and other elements entering the closed space from positions which are substantially horizontal to or below the vent cap. As is currently known in the art, water can cause significant problems in the operation or longevity of the devices or structures typically associated with the vent and vent cap.

SUMMARY OF THE INVENTION

To overcome these disadvantages, the present invention is realized through an improved vent apparatus. The improved vent apparatus includes a vent tube with a first end extending outside of the closed space and a second end extending into a closed space, a vent cap attached to the first end for keeping water, snow, ice and other elements from entering the vent tube. The vent cap includes a top, a continuous side wall extending in a downward direction from the top and a cap opening through which air enters the vent tube. The vent cap also includes an annular structure located on an inside top portion of the vent cap for enabling the vent cap to be removably coupled to the vent tube. It should also be understood that the closed space may exist as part of a variety of distinct structures, which require an exhaust port that may be exposed to the elements, such as a home or building, a boat, a car or any other motorized vehicle.

A better understanding of the objects, advantages, features, properties and relationships of the invention will be obtained from the following detailed description and accompanying drawings which set forth an illustrative embodiment and is indicative of the various ways in which the principles of the invention may be employed.

DETAILED DESCRIPTION OF THE DRAWINGS

Figure 1:
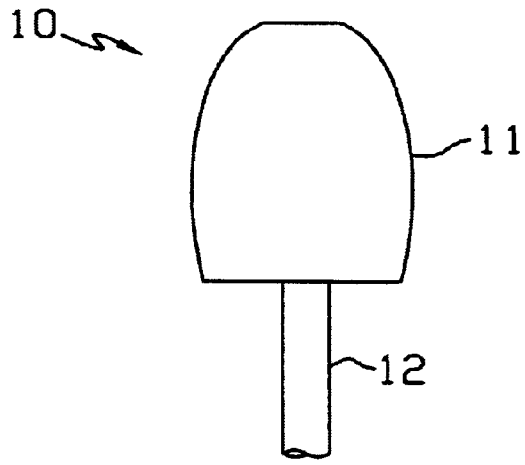
FIG. 1 is a side elevational view of a vent cap in accordance with one embodiment of the present invention.
Figure 2:
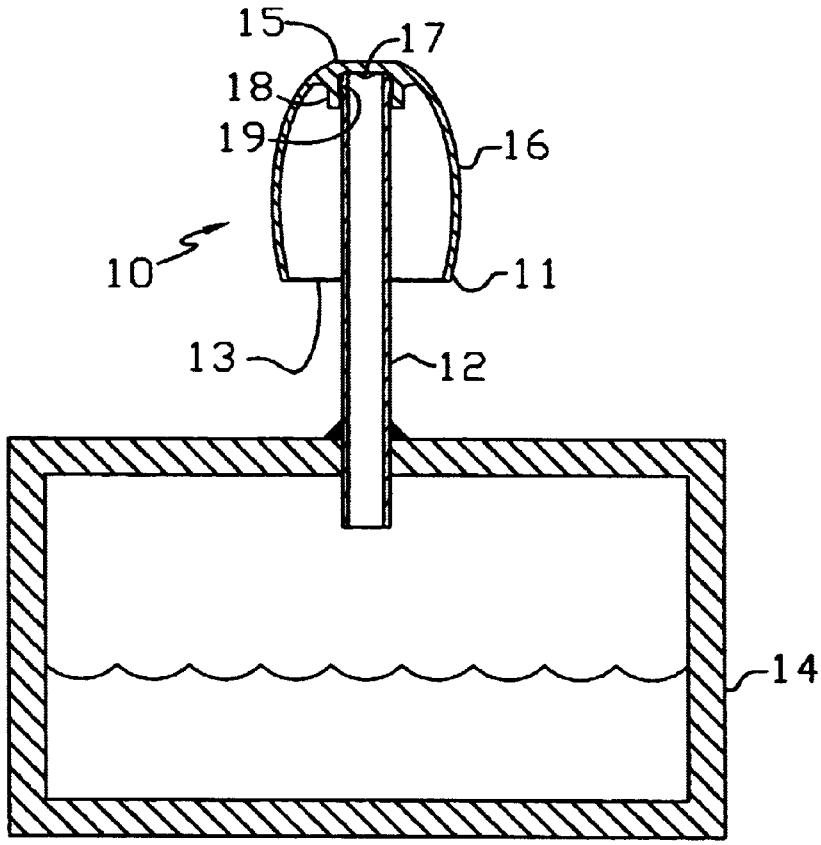
FIG. 2 is a sectional view of the vent apparatus shown in FIG. 1 in combination with a closed space.

Turning now to the figures, wherein like reference numerals refer to the like elements, there is illustrated a vent apparatus 10 for providing airflow to a closed space, while also preventing water or other similar elements from entering the closed space. FIGS. 1 and 2 depict a simplified version of the vent apparatus 10, having a vent cap 11 mounted to a vent 12, which is mounted to and extends into a closed space 14. The vent cap 11 is generally bowl shaped and includes a top 15, a continuous side wall 16 and an opening 13. To shield the vent 12 and vent opening 17 from the elements, the side wall 16 extends in a generally downward direction from the top 15 and toward the opening 13.

Protrusion 19 are integrally formed on vent tube 12 and interact with inner ring 18 which extends downwardly from top 15 to permit vent cap 11 to pivot with respect to vent tube 12.

For preventing water from entering the closed space, the vent cap 11 is mounted to the vent 12 in a manner which allows the vent cap 11 to pivot with respect to the vent 12. Operation of the present invention can be seen most clearly in FIG. 3, where the arrows depict the direction of possible water spray against the apparatus. In this embodiment, a vent tube 24 extends down into the closed space (not shown), the vent tube 24 has a first end that extends outside of the closed space and a second end that extends within the closed space. The vent cap 11 may be removably coupled to a fitting 22 that may be attached to the first end of the vent tube 24. Fitting 22 also includes a passage 26 having a top and a bottom. The top of the passage has a first opening 27 and the bottom of the passage has a second opening 29; the second opening 29 opens into the vent tube 24. It will be understood that the specific arrangement and appearance of passage 26 is not critical to this invention.

Figure 3:
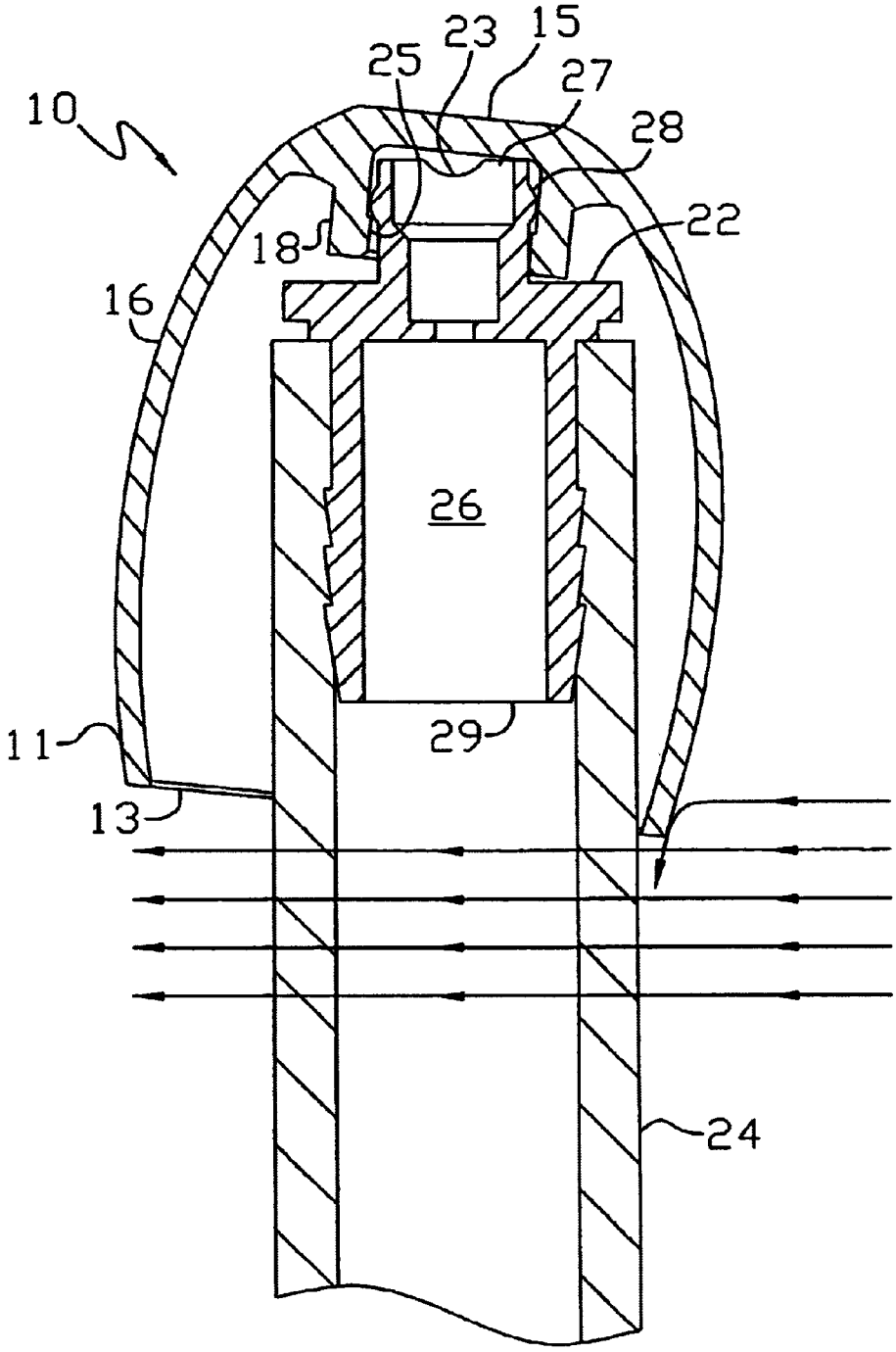
FIG. 3 is a cross sectional side view of a vent cap in accordance with a second embodiment of this invention.

For allowing the vent cap 11 to pivot with respect to the vent 12, the vent cap 11 may include an inner ring, 18 extending downwardly from the inside of top 15 and having an inner circumference sized to cooperate with and fit over the top of fitting 22. Thus, the cooperation of the inner ring 18 and the fitting 22 enable the vent cap 11 to pivot about the longitudinal axis of vent tube 24 and fitting 22. As shown in FIG. 3, when water spray contacts the side wall 16 of vent cap 11, the entire vent cap 11 swivels or pivots with respect to the vent tube 12, so that the bottom of side wall 16 contacts vent tube 24 to aid in deflecting water away from the first opening 27 of the passage 26, thereby minimizing the amount of water that may enter the vent cap 11.

As exemplified in the embodiment shown in FIG. 3, the pivoting action may be achieved by the interaction between fitting 22 and the inner ring 18. Specifically, fitting 22 has an annular structure 28 formed thereon which protrudes outwardly from fitting 22 to contact the inner circumference of ring 18. Ring 18 may also have an annular structure 25 which extends inwardly from the inner circumference of the ring 18. The interaction of annular structures 25 and 28 permit the vent cap 10 to be coupled to the fitting 22, while still permitting the vent cap 11 to pivot as described above. It is preferred that the height of vent cap 11 (i.e., the distance from top 15 to opening 13) be at least twice the distance measured from the top of fitting 22 to the top of vent tube 24.

To aid airflow via opening 27, a notch or aperture 23 may be provided on the top of the fitting 22. Therefore, it is important that the interaction between the fitting 22 and the cap 11 be such that it does not create an air-tight seal, as this would defeat the purpose of the vent. It should be appreciated by those with skill in the art that other designs may be employed for creating a space to allow for airflow between the opening 13 and the passage 26.

Figure 4A:
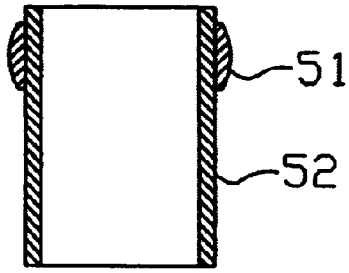
FIGS. 4A, 4B and 4C depict alternative embodiments of an annular structure of the vent on which the vent cap may be secured.
Figure 4B:
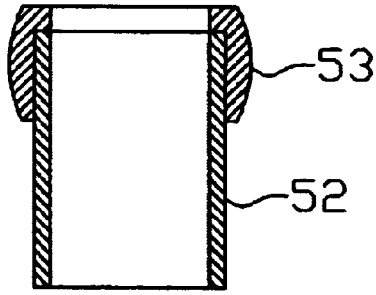
Figure 4C:
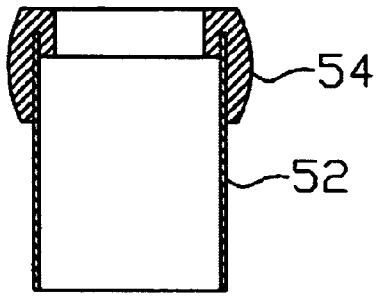

FIGS. 4A, 4B and 4C show alternative embodiments of an engagement structure formed on the vent to permit the swiveling or pivoting motion of the vent cap. Specifically, FIG. 4A shows an annulus 51 that may be glued or pressed on to vent tube 52. FIG. 4B shows a different annulus 53 which may be press fit or glued on to vent tube 52. FIG. 4C shows an alternative embodiment of a possible press fit annulus 54. The benefit of these designs is that they may be provided as a retrofit kit for use with existing vents or with materials such as extruded pipes where forming such features are difficult or impossible. Therefore, the user is provided with an easy manner to obtain the benefits of the vent cap of the present invention without the need of replacing expensive components. In the preferred embodiment, the annuluses or annuli in FIGS. 4A–C are composed of a nitryl or plastic gasket; for a retrofit kit the composition of the annulus may depend to a large extent on the material used for the existing vent to which the annulus will be applied. While these structures 51, 53 and 54 have been described and shown as an annulus extending around the entire circumference of the vent tube 52, they need not extend around the entire outer circumference of the vent tube 52 in order to achieve the swiveling feature of this invention. It should also be appreciated that the structures 51, 53 and 54 may also be attached to a fitting 22, as described above, instead of the tube 52.

Figure 5A:
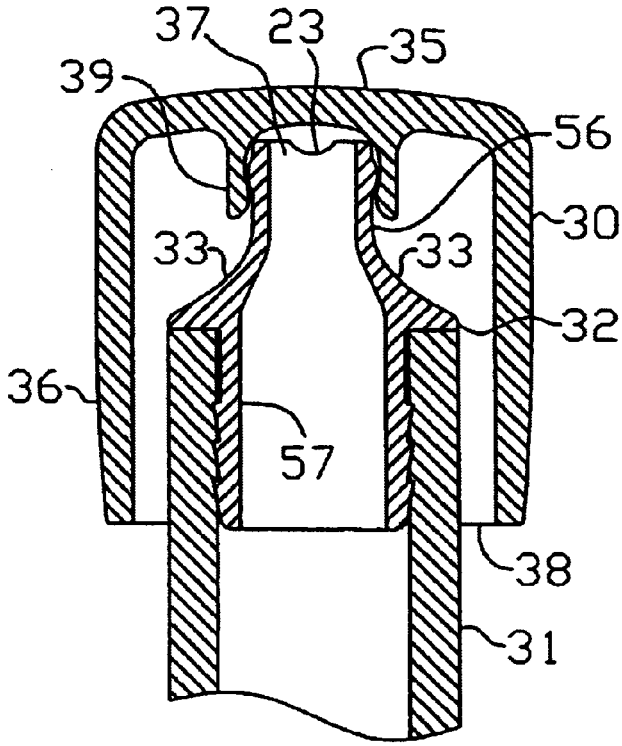
FIG. 5A is a cross-sectional side view of an alternative embodiment of the vent cap in accordance with the present invention.
Figure 5B:
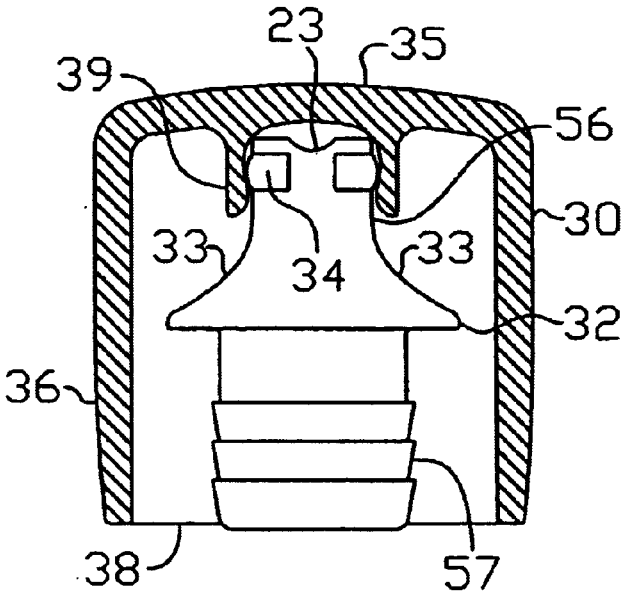
FIG. 5B is a partial cross-sectional view of certain components of the embodiment shown in FIG. 5.

FIGS. 5A and 5B show an alternative embodiment of the present invention. In this embodiment, vent cap 30 may be mounted to fitting 32, which is mounted within vent tube 31. The fitting 32 comprises a body 57 and a neck portion 56 integrally formed therewith. The neck portion 56 of the fitting 32 may have curved shoulder portions 33 to prevent water from accumulating thereon, and an opening 37 formed at its top. Thus, if water does enter the inside of the vent cap 30, it will not accumulate near the top of fitting 32; this prevents capillary action from introducing water through vent opening 37. To see the external structure of the fitting more clearly, FIG. 5B eliminates the tube 31 shown in FIG. 5A and does not show fitting 32 in cross-section.

The alternative embodiments shown in FIGS. 5A and 5B include a vent cap 30 with a generally flat top portion 35 and a continuous side wall 36 extending downward therefrom to an opening 38, which is formed at the bottom of the vent cap 30. The side wall 36 is substantially perpendicular to top 35, which is primarily based on the ease of manufacturing a side wall 36 that is perpendicular to the top 35. An inner ring 39 may be formed on the inner surface of top 35 as an engagement structure for fitting 32. The top of fitting 32 and inner ring 39 are shaped to permit movement of the bottom portion of cap 30, (i.e., adjacent to opening 38) relative to tube 31. In this embodiment, an annular structure 34 may be mounted on the neck portion 56 of the fitting 32. As shown in FIG. 5B, the annular structure 34 may not extend around the entire circumference of the neck portion 56 of the fitting 32, as gaps in the annular structure 34 may be used to enhance airflow in and out of vent opening 37. The annular structure 34 may be integrally formed with neck 56 or it may be attached to the neck 56, as described in FIGS. 4A–C. As further exemplified in FIGS. 5A and 5B, the ring 39 may not require a separate protrusion formed thereon to create the necessary interaction between the neck portion 56, the annular structure 34 and the ring 39. Rather, the ring 39 forms a wall and the wall simply has an increased diameter at the bottom thereof to permit the neck portion 56 and the annular structure 34 to be removably coupled by snapping the annular structure 34 into the ring 39, thus, permitting cap 30 to swivel or pivot with respect to the tube 31 and the fitting 32. The design shown in FIGS. 5A and 5B may also be used in connection with other embodiments of the present invention, which require the cap 11 to be mounted directly on the tube 12; therefore, a separate internal fitting may not be required.

Figure 6A:
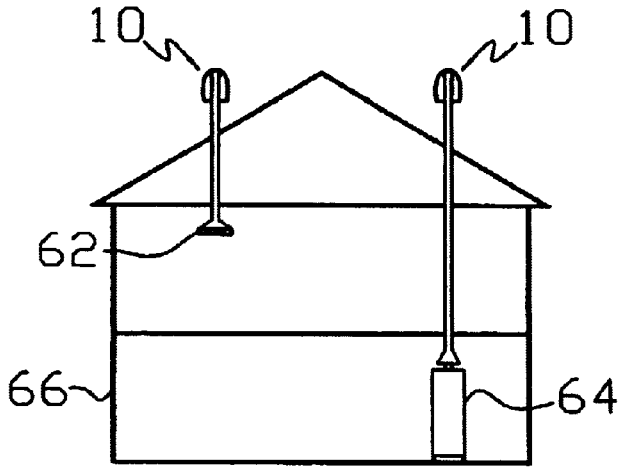
FIGS. 6A, 6B and 6C depict the vent apparatus shown in FIG. 1 in combination with varying structures which include an enclosed space with which the vent apparatus cooperates.
Figure 6B:
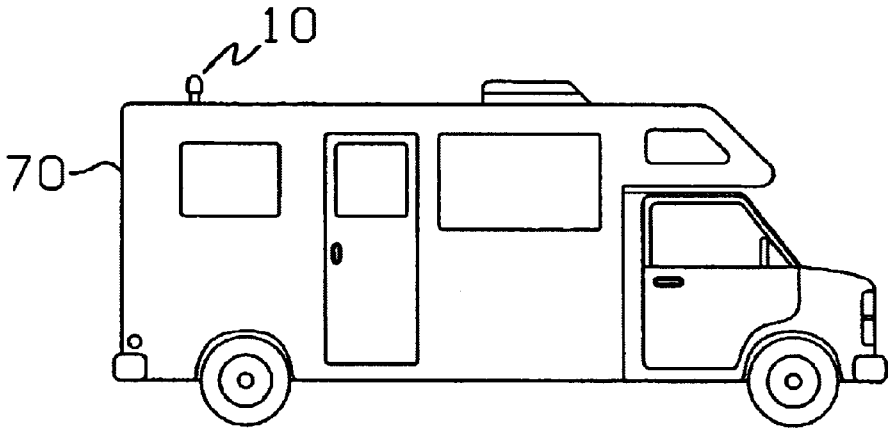
Figure 6C:
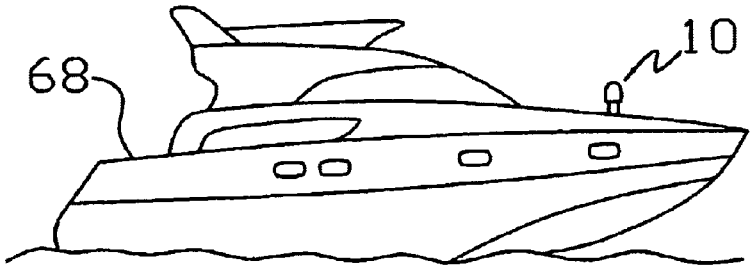

As shown in FIGS. 6A, 6B and 6C, the present invention may be used in connection with a variety of different structures. For example, FIG. 6A depicts the vent apparatus 10 being used in connection with a fan 62, such as may be used with a restroom, or an HVAC system 64 of a building 66 such as an office or home. In addition, FIG. 6B shows the vent apparatus 10 being used in connection with a motor vehicle 68 and FIG. 6C shows the vent apparatus 10 coupled to a vent pipe of a boat 70. It should be appreciated by those with skill in the art that the vent apparatus 10 described herein may be used with any structure having an enclosed space to provide the enclosed space with a continual airflow while also preventing water or similar elements from entering the enclosed space.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A vent apparatus for a structure having a closed space, comprising:

a vent tube having a first end located outside the structure and a second end connected to the closed space of the structure;

a fitting mounted in the first end of the vent tube and comprising an opening formed therein for permitting air to flow through the fitting to and from the vent tube and a first engagement structure mounted thereon;

a vent cap mounted to the fitting and comprising a top surface integrally connected to a continuous side wall extending downwardly from the top surface, whereby the combination of the vent cap and the fitting permits air flow in and out of the closed space and the vent cap is capable of pivoting with respect to the longitudinal axis of the vent tube.

2. A vent apparatus as set forth in claim 1, wherein the first engagement structure is integrally formed on the fitting.

3. A vent apparatus as set forth in claim 1, wherein the first engagement structure is glued to the fitting.

4. A vent apparatus as set forth in claim 1, wherein the first engagement structure is press-fit on the fitting.

5. A vent apparatus as set forth in claim 1, wherein the structure containing the closed space is a building.

6. A vent apparatus as set forth in claim 1, wherein the closed space is within a motorized vehicle requiring an exhaust port.

7. A vent apparatus as set forth in claim 1, wherein the fitting includes at least one aperture formed in the side of the fitting and proximate to the top thereof.

8. A vent apparatus for a structure having a closed space, comprising:

a vent having a first end and a second end, where the first end of the vent extends outside of the closed space and the second end of the vent is connected to the closed space;

a first engagement structure located on the vent proximate to the first end thereof;

a vent cap mounted on the first end of the vent, the vent cap comprising a generally cylindrical body with a closed top and open bottom;

a second engagement structure located on the inner surface of the vent cap and cooperating with the first engagement structure to allow the vent cap to be removably coupled to the vent and to pivot with respect to the vent; and an opening associated with the bottom of the vent cap and the first end of the vent to permit airflow in and out of the closed space.

9. A vent apparatus as set forth in claim 8, where the vent further comprises:

a generally cylindrical tube having a first end and a second end, where the first end extends outside of the closed space and the second end extends outside of the closed space.

10. A vent apparatus as set forth in claim 9, where the first engagement structure comprises an annulus integrally formed on the vent.

11. A vent apparatus as set forth in claim 9, where the first engagement structure is press-fit on the fitting.

12. A vent apparatus as set forth in claim 9, where the first engagement structure is glued to the fitting.

13. A vent apparatus as set forth in claim 10, wherein the annulus extends around the entire circumference of the outer portion of the second end of the fitting.

14. A vent apparatus as set forth in claim 8, wherein the second engagement structure is formed on an annular ring extending downwardly from inside of the top of the vent cap.

15. A vent apparatus as set forth in claim 8, wherein the structure containing the closed space is a building.

16. A vent apparatus as set forth in claim 8, wherein the closed space is within a motorized vehicle requiring an exhaust port.

17. A kit for use with a structure having a closed space and a vent tube, the vent tube having a top end extending from the closed space and a bottom end connected to the closed space, the kit comprising:

a first engagement structure which may be mounted proximate to the top end of the vent tube to form an enlarged radial portion on the top of the vent tube;

a vent cap capable of being removably attached to the top end of the vent tube, the vent cap comprising a generally cylindrical body having a top portion which is closed and a bottom portion which is open, and a second engagement structure on the inner surface of the top portion and shaped to cooperate with the first engagement structure, whereby the vent cap is able to pivot with respect to the tube.

18. A kit as set forth in claim 17, wherein the first engagement structure extends around the entire circumference of the vent tube.

19. A kit as set forth in claim 17, wherein the first engagement structure is glued to the vent tube.

20. A kit as set forth in claim 17, wherein the first engagement structure is press-fit on the vent tube.

21. A kit as set forth in claim 17, wherein the structure containing the closed space is a building.

22. A kit as set forth in claim 17, wherein the closed space is within a motorized vehicle requiring an exhaust port.

* * * * *